US008807158B2

(12) United States Patent
Harris et al.

(10) Patent No.: US 8,807,158 B2
(45) Date of Patent: Aug. 19, 2014

(54) EDUCTOR ASSEMBLY WITH DUAL-MATERIAL EDUCTOR BODY

(75) Inventors: Jaime Leonard Harris, Rosemount, MN (US); Gary Allen Brown, Faribault, MN (US)

(73) Assignee: Hydra-Flex, Inc., Burnsville, MN (US)

( * ) Notice: Subject to any disclaimer, the term of this patent is extended or adjusted under 35 U.S.C. 154(b) by 35 days.

(21) Appl. No.: 11/335,105

(22) Filed: Jan. 19, 2006

(65) Prior Publication Data

US 2006/0157131 A1 Jul. 20, 2006

Related U.S. Application Data

(60) Provisional application No. 60/645,777, filed on Jan. 20, 2005.

(51) Int. Cl.
*B01F 5/04* (2006.01)

(52) U.S. Cl.
USPC ..... 137/375; 137/889; 264/279; 285/293.1; 285/294.1

(58) Field of Classification Search
USPC ..... 137/889, 375; 264/271.1, 274, 275, 264/277, 279; 285/293.1, 294.1
See application file for complete search history.

(56) References Cited

U.S. PATENT DOCUMENTS

| | | | | | |
|---|---|---|---|---|---|
| 3,614,137 | A * | 10/1971 | Jacobson | ..... | 285/390 |
| 3,825,030 | A * | 7/1974 | Kalsi | ..... | 137/375 |
| 4,146,059 | A * | 3/1979 | Heilmann | ..... | 138/109 |
| 4,508,272 | A | 4/1985 | Thompson | | |
| 4,988,077 | A * | 1/1991 | Conley et al. | ..... | 251/309 |
| 5,522,419 | A * | 6/1996 | Sand | ..... | 137/216 |
| 5,622,203 | A * | 4/1997 | Givler et al. | ..... | 137/337 |
| RE37,617 | E * | 4/2002 | Sherman | ..... | 137/557 |
| 6,571,824 | B2 * | 6/2003 | Jones et al. | ..... | 137/597 |
| 6,755,207 | B1 * | 6/2004 | Curtis et al. | ..... | 137/205 |
| 6,852,264 | B2 * | 2/2005 | Ouellette | ..... | 264/328.1 |

* cited by examiner

*Primary Examiner* — William McCalister
(74) *Attorney, Agent, or Firm* — Patterson Thuente Pedersen, P.A.

(57) ABSTRACT

An improved venturi-style eductor apparatus for dispensing chemicals into a motive fluid stream where an eductor body FIG. 3 is manufactured by molding a chemically inert polymer material FIG. 2 around and inside a metallic insert FIG. 1. Opposing ends of the metallic insert may be threaded, flanged, or machined for push-in connection to facilitate mating with a motive fluid source and a dispensing device. By manufacturing an eductor assembly using a single-piece metal insert over-molded with an inert polymer provides improved chemical resistance for aggressive applications and allows improvements in venturi geometry not achievable using traditional machined components. This apparatus reduces manufacturing cost over current state-of-the-art eductor assemblies by using a single molding step to create flow-path geometry in the eductor body while retaining mechanical strength with the metallic insert FIG. 1.

6 Claims, 8 Drawing Sheets

EDUCTOR ASSEMBLY WITH DUAL-MATERIAL EDUCTOR BODY

RELATED APPLICATION

The present application claims the benefit of U.S. Provisional Application No. 60/645,777 filed Jan. 20, 2005, which is incorporated herein in its entirety by reference.

BACKGROUND OF THE INVENTION

Venturi-style eductors used to educt a second fluid into a primary motive fluid stream are established fluid handling devices and are used commonly in industrial applications, cleaning applications, and food services. A typical such device may be found in Thompson, U.S. Pat. No. 4,508,272. Common to any such device is an inlet orifice for a motive stream, most often water, where the diameter of the inlet orifice is larger than the smallest diameter in a converging flow-path. Immediately downstream of the converging flow-path is a mixing zone having a diameter larger than the smallest restriction in the converging zone. Transverse to the motive flow path, a port is tapped into an eductor body such that an eduction flow path communicates with the motive flow path at the mixing zone. Bernoulli's equation demonstrates that suction is created in the mixing zone allowing a second solution to be drawn, or educted, into the mixing zone. It is through this transverse path that suction draws mentioned second fluid into the mixing zone whereby the second fluid and motive fluid become mixed. Downstream from the mixing zone the flow path diverges or widens in cross-section to conduct the mixture of motive fluid and educted second fluid to the eductor outlet.

Traditional venturi-style eductors are assembled using multiple components to comprise the main body of the device. Prior art focuses on using machined eductor components from metallurgies resistant to chemical attack and corrosion. Machinable stainless steel and brass are most common. Given the complex geometry a venturi flow path and the limitations of machining technology, multiple parts are manufactured and then assembled to create the main body of an eductor. While such devices work satisfactorily they are costly to manufacture and have limitations with respect to the flow path geometry. Some chemical applications require the use of a chemical that is not suited to available metallic eductors considering corrosion potential constituting a further limitation.

Prior art does mention venturi-style eductors having molded integral components as in Sand U.S. Pat. No. 5,522,419 though in this invention reveals wetted brass surfaces and multiple machined components.

SUMMARY OF THE INVENTION

The present invention combines the strength of a metallic insert with the chemical resistance of an inert molded polymer to form a less expensive eductor housing or body as part of an Eductor Assembly. Primary wetted surfaces in the eductor body are formed from chemically resistant polymer. The complete eductor assembly is comprised of said molded body, a molded nozzle placed inside and coaxially to a molded venturi flow path within the eductor body, and one or two injection assemblies fastened to the eductor body to allow introduction of chemical to the motive flow path. One embodiment incorporates two injection assemblies allowing two separate chemicals to be educted into the motive flow while yet another embodiment is more traditional in having a single injection assembly attached to the eductor body allowing a single fluid to be educted into and mixed with the motive fluid. Inlet and outlet ends of the eductor assembly are threaded to allow attachment of the inlet end to a primary or motive fluid source and the attachment of the outlet end to a dispenser which receives a mixture of the motive fluid and chemicals introduced into the eductor legs of the assembly. Injection assemblies attached to the eductor body may incorporate several geometries as a means of connecting to a chemical supply.

In one embodiment of the invention the threaded geometry on the eductor body inlet end and separately the outlet end is accomplished by insert molding either stainless steel or brass threaded connections to the outside diameter of the molded flow path. In this instance the metal inserts used do not contact fluid in the eductor.

A further embodiment of the invention describes an eductor assembly whereby the injection assemblies are attached to the eductor body by the process of spin welding or ultra-sonic welding.

DETAILED DESCRIPTION

The preferred embodiment will be described in enabling detail in the following text supported by the drawings. The object of this invention is to address all equivalences narrower in scope than the subsequently described invention. In essence this invention is intended to address venturi-style eductors incorporating what is described herein.

Figure 1:
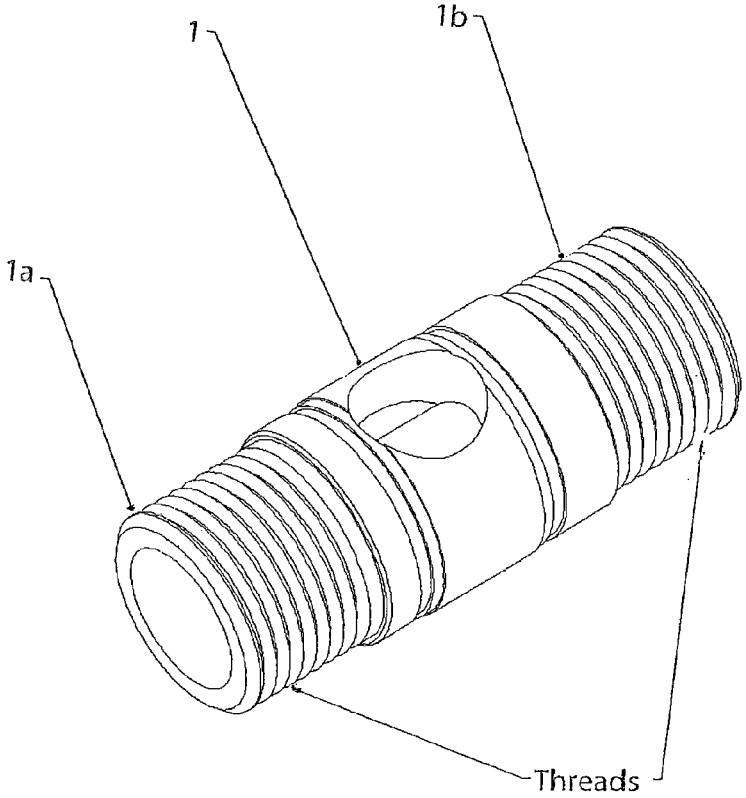
FIG. 1 is a perspective view depicting a metal insert or housing having threads machined on outside diameters of both ends.
Figure 2:
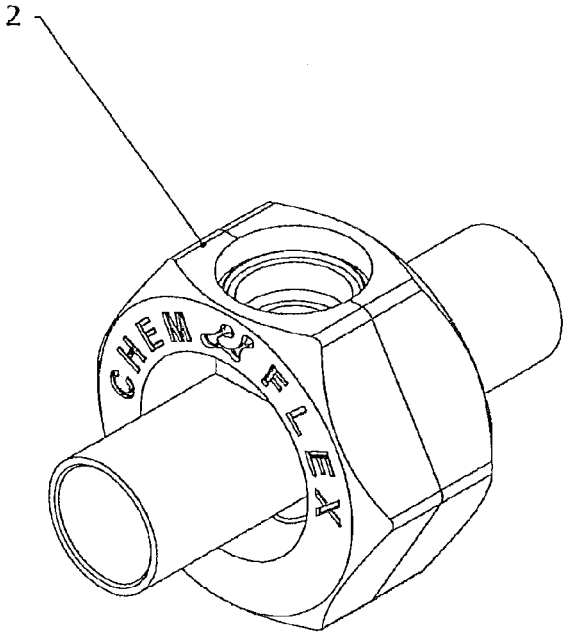
FIG. 2 is a perspective view illustrating discrete molded polymer geometry.
Figure 4:
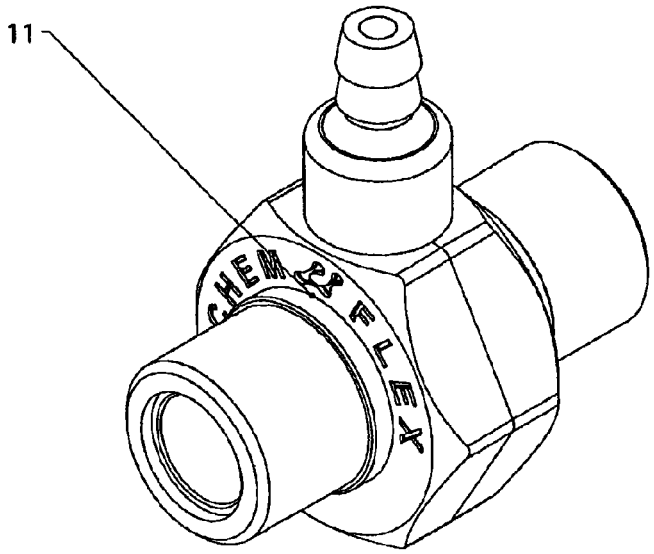
FIG. 4 is a perspective view of a single eductor leg injector assembly illustrating one embodiment of the present invention.
Figure 5:
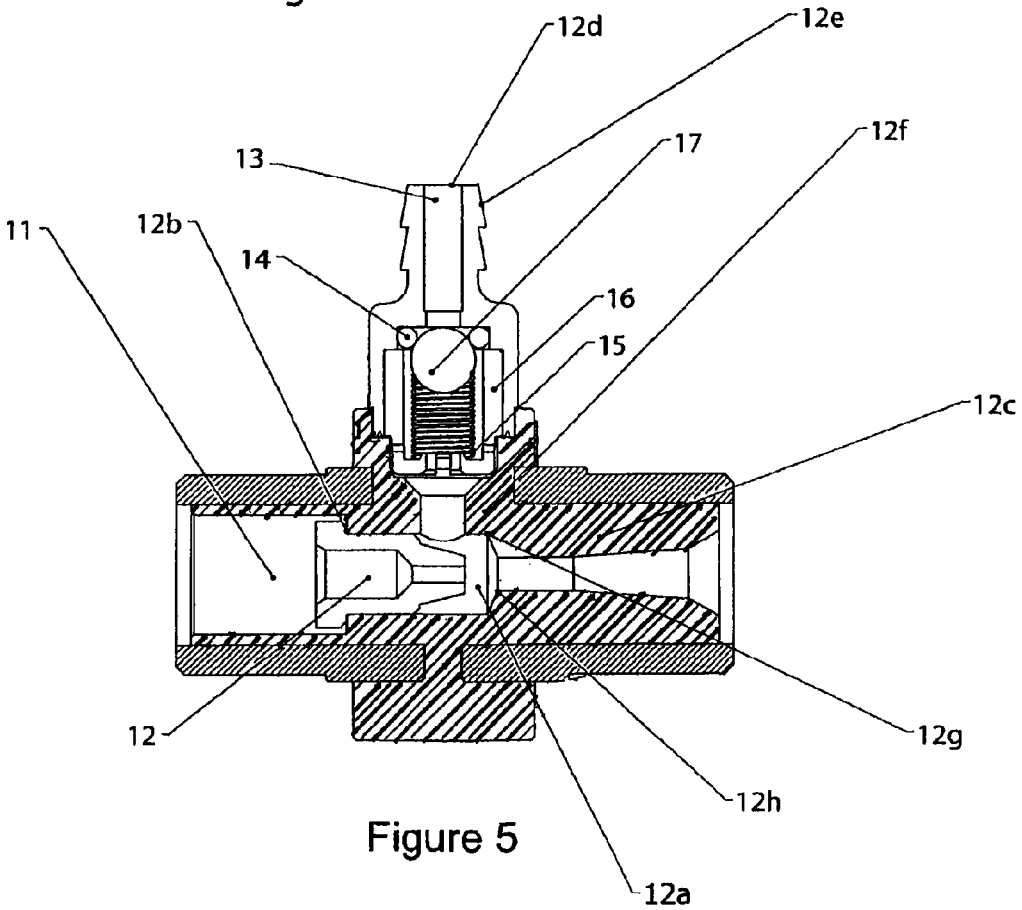
FIG. 5 is a cross-section view of the single eductor leg injector assembly as described in FIG. 4.

FIGS. 4 and 5 illustrate one embodiment of the present invention wherein a metallic insert 1 as in FIG. 1 is overmolded with an inert polymer 2 having geometry shown in FIG. 2. In this embodiment material used in the molding process is a polyvinylidene fluoride (PVDF) polymer. PVDF is chosen based upon its chemical inertness and strength.

Figure 3:
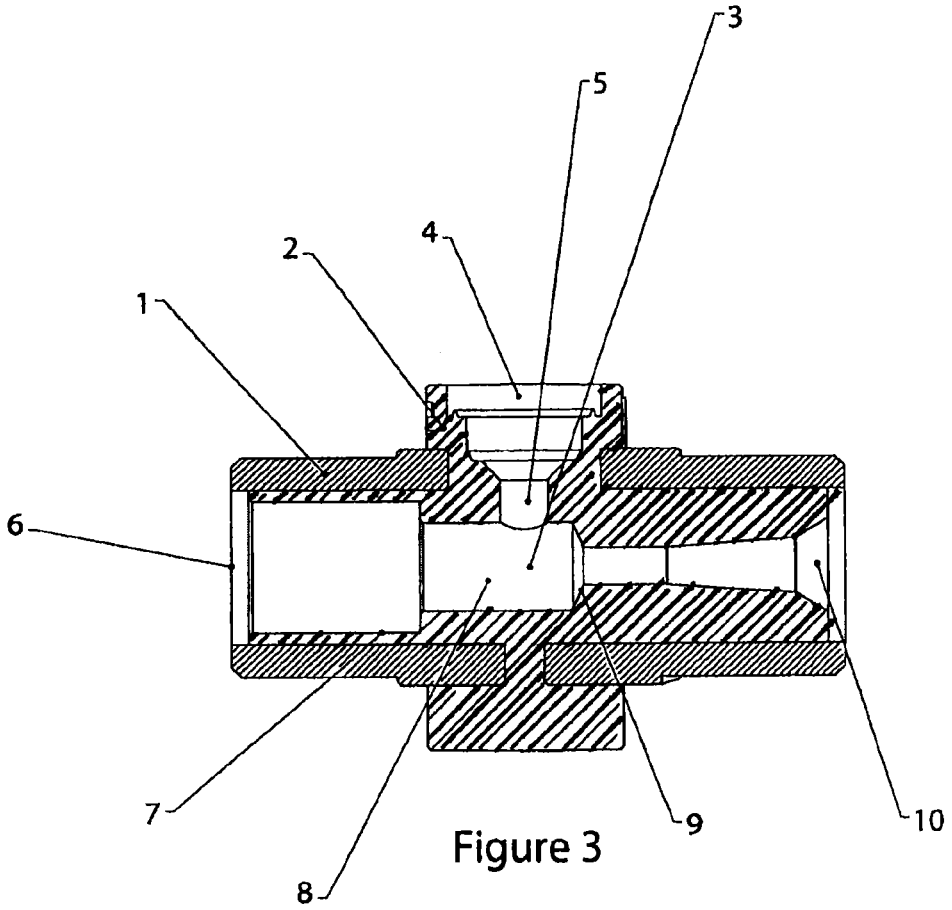
FIG. 3 is an axial cross-section view showing the insert from FIG. 1 with the molded geometry from FIG. 2 combined.

Brand names included in the PVDF family include KYNAR and DYFLOR. It is the intent of this invention to include any inert polymer with desirable mechanical properties in the molding process. The metallic insert as depicted in FIG. 1 has machined threads on the outside diameter of an inlet end 1*a* and an outlet end 1*b*. Material used for the metallic insert is typically, but not limited to, a 300 series grade stainless steel or machinable brass. The cross-section in FIG. 3 illustrates the combination of the metal insert FIG. 1 over-molded with the inert polymer FIG. 2. The combination of the metallic insert FIG. 1 and the molded polymer FIG. 2 creates the eductor body or housing for the venturi style eductor apparatus shown in FIG. 4. The cross section in FIG. 3 further reveals that a single molding process results in flow path geometries for both a motive fluid stream 3 and an eductor leg 4 having an injector inlet 5. A body inlet 6 for the motive fluid stream 3 having a larger diameter 7, a reduced diameter 8 to allow a spray nozzle to be inserted later, a venturi throat 9, and a diverging flow path 10 to allow a combination of motive fluid (typically water) and mixed chemical to be conducted away from the venturi apparatus FIGS. 4 & 5.

The cross-section in FIG. 5 illustrates the complete assembly of the single eductor leg injector apparatus. All components used in the single eductor leg injector assembly are shown. In this embodiment motive fluid enters a motive fluid path at the inlet of the eductor body 11. Motive fluid (typically water) then passes through a spray nozzle 12 entering a mixing zone 12*a* immediately thereafter. The spray nozzle 12 is a separate molded component typically molded from a PVDF material. The spray nozzle 12 is coaxially aligned with the motive flow path in the eductor assembly and fastened to the internal diameter of the molded flow path at the step 12*b* in the molded geometry of the eductor body. Methods of fastening the spray nozzle to the molded eductor body include spin welding and ultra-sonic welding. After motive fluid exits the spray nozzle 12, it enters the mixing zone 12*a* wherein educted chemical and motive fluid combine and are then conducted out of the eductor assembly through a divergent zone 12*c* downstream of the mixing zone 12*a*. Educted chemical is fed to an eductor leg inlet passageway 13 of subassembly 12*d* which is comprised of an injection housing 12*e*, a retention sleeve 16, a spring 15, a check ball 17, and a check valve o-ring 14. In this embodiment, the injection housing 12*e* is fastened to the molded eductor body geometry 12*f* by either ultra-sonic welding or spin welding (friction welding). The injection housing 12*e* houses the retention sleeve 16, the spring 15, the check ball 17, and the o-ring 14. A vacuum created in a venturi 12*g* contained in the eductor body motive fluid path educts concentrated chemical through the eductor leg inlet passageway 13. Suction from the venturi 12*g* overcomes spring force resulting from the spring 15 and allows concentrated chemical to flow past the check-ball 17 and into the mixing zone 12*a* wherein motive fluid (typically water) and concentrated chemical are mixed.

Improvements over prior art represented in this embodiment include a single inert polymer material in primary flow path geometry. Primary wetted surfaces are inert polymer material and therefore the eductor assembly is resistant to chemical attack. From FIG. 5 the molded motive fluid flow path between 11 & 12*c*, the spray nozzle 12, the retention sleeve 16, and the eductor leg inlet passageway 13, are all molded from inert polymer material. Methods of manufacturing a venturi throat in prior art are largely limited to CNC machining inasmuch as motive flow path geometry is typically manufactured from machined stainless steel or brass. Related limitations prevent optimal venturi efficiency. The present invention allows molded geometry in the venturi throat that improve venturi efficiency. Specifically in the transition from the venturi throat 12*g* to the divergent flow path 12*c* in FIG. 5 a radius may be molded at 12*h* enhancing venturi efficiency. The combination of a metal insert FIG. 1 and the molded geometry in FIG. 2 provide both strength and resistance to chemical attack.

Figure 7:
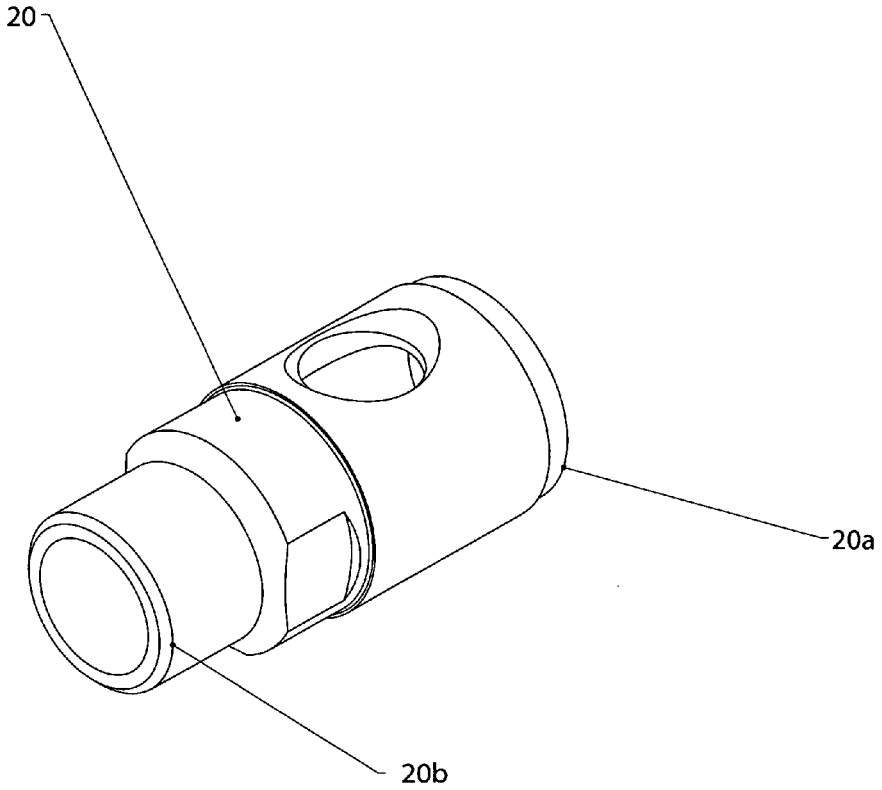
FIG. 7 is perspective view showing a metal insert or housing having a single threaded end and an opposing flanged or seal face axially aligned.
Figure 8:
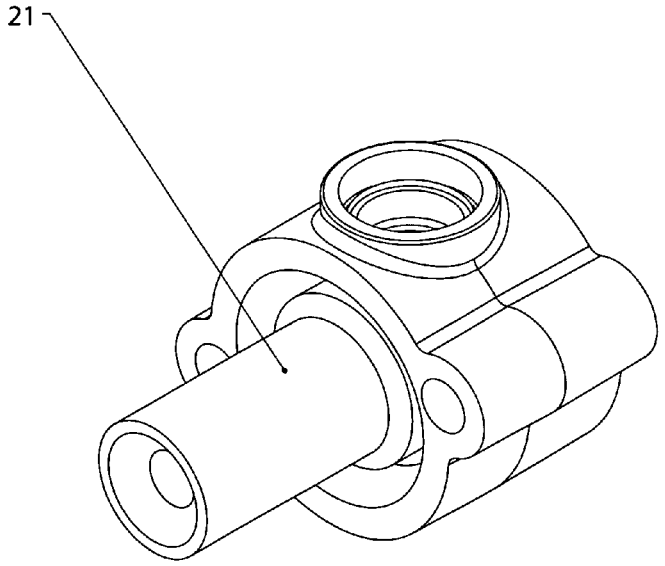
FIG. 8 is a perspective view illustrating discrete molded polymer geometry separate from the insert shown in FIG. 7.
Figure 9:
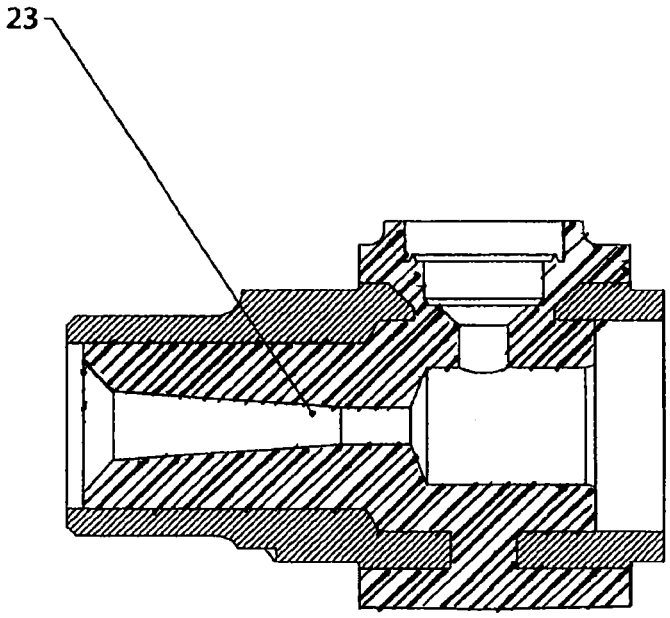
FIG. 9 is an axial cross-section showing the insert from FIG. 7 molded into the polymer geometry shown in FIG. 8.
Figure 10:
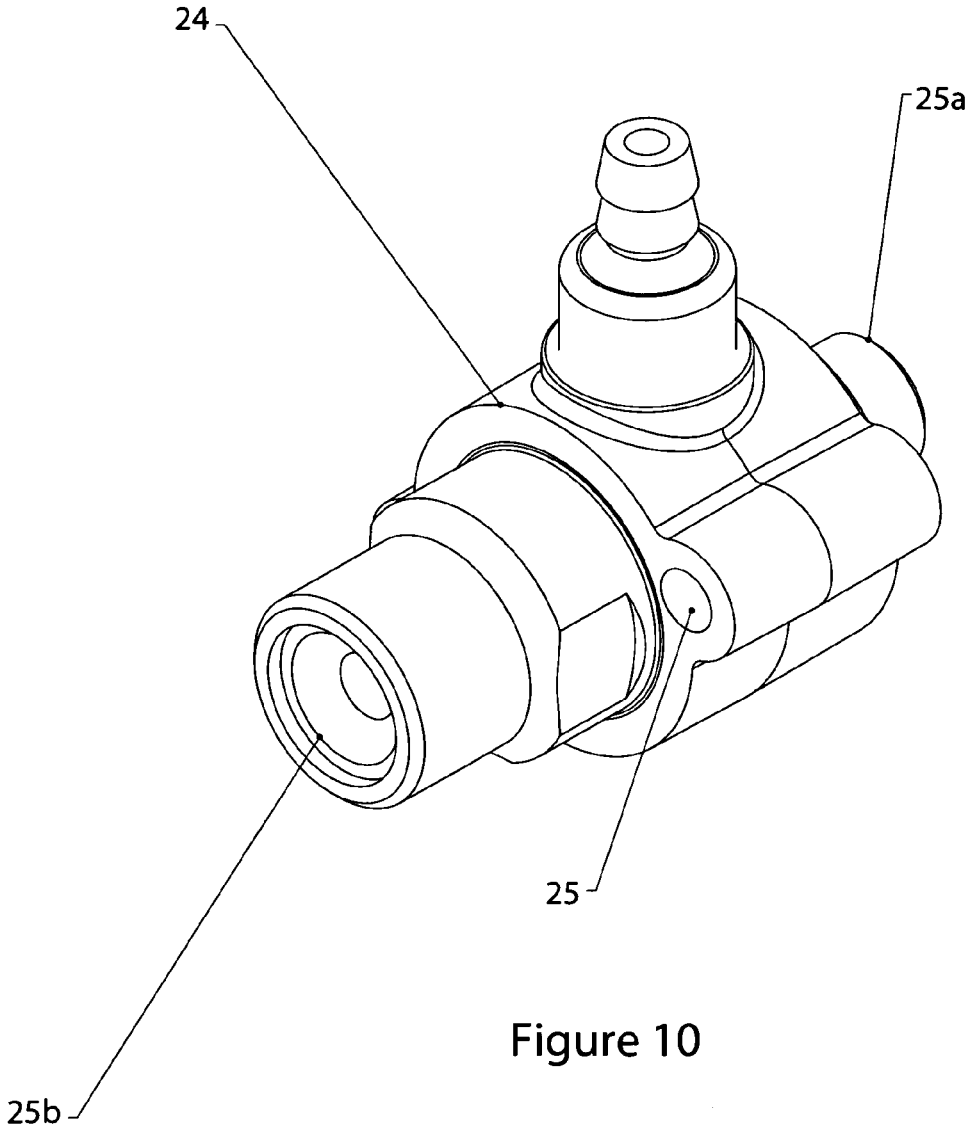
FIG. 10 is a perspective view of another embodiment of the present invention depicting an injector assembly with a single eduction leg and having one threaded end opposed by and axially aligned with a flanged end.
Figure 11:
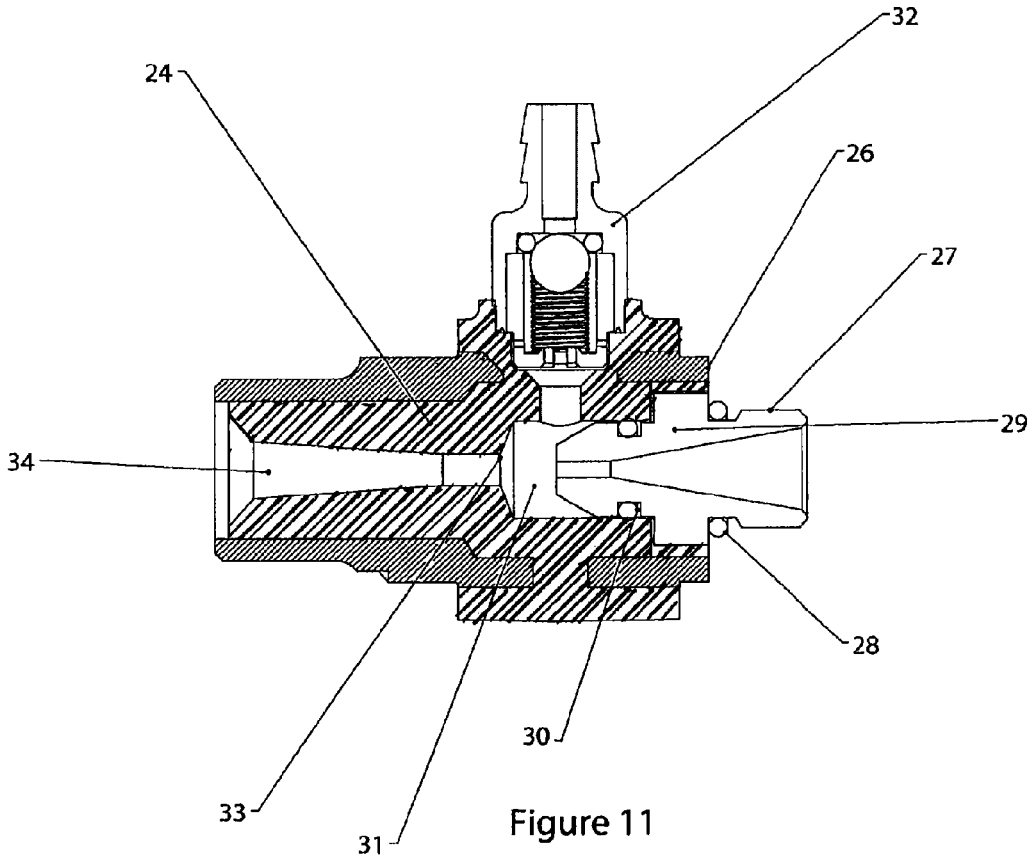
FIG. 11 is a cross-section view of the injector assembly illustrated in FIG. 10.

FIG. 10 represents another embodiment of the present invention illustrating an injector assembly having a flanged connection 26 on a receiving end 25*a* and a threaded opposing outlet end 25*b*. FIG. 11 illustrates a cross section view of the assembly depicting all components of said assembly. In this embodiment a metal insert 20 as shown in FIG. 7 is over-molded with a polymer geometry 21 shown in FIG. 8. The resulting eductor body 23 or housing is illustrated in cross section view in FIG. 9. Material selection for the metal insert 20 in FIG. 7 and the polymer geometry 21 in FIG. 8 are the same as mentioned in the prior embodiment. The metal insert 20 shown in FIG. 7 has a flanged end 20*a* for connection to an upstream receiving device, typically an inlet manifold, and an opposing axially aligned threaded end 20*b*. Threading is machined on the outside diameter of the insert. Referring again to FIG. 11 the components of the assembly include a spray nozzle 29 inserted into the injector assembly 24. An o-ring 30 forms a hermetic seal between said spray nozzle 29 and injector assembly 24. As in the prior embodiment, a motive fluid, typically water, passes through the spray nozzle 29 and enters the mixing zone 31 wherein concentrated chemical is drawn through an eductor subassembly 32 by vacuum created in a venturi section 33 and mixes with the motive fluid where after the resulting mixture flows through the divergent section 34 downstream of the mixing zone 31. In this embodiment, the eductor subassembly is identical to that described in the previous embodiment. In this embodiment the spray nozzle shown in 29 of FIG. 11 is manufactured from stainless steel or machinable brass having a threaded end 27 for future connections to an upstream device. The means of connection to said upstream device, typically an inlet manifold, is by using a bolted connection and o-ring seal 28. FIG. 10 illustrates bolt holes 25 integral to the molded geometry FIG. 8. This feature provides the means for bolting the injector assembly 24 of FIG. 10 to an upstream device. This embodiment reflects similar advantages to the prior embodiment in that primary wetted surfaces are inert polymer and the molded flow path allows optimal geometry for the venturi section 33 of FIG. 11. The combination of a metallic insert and over-molded polymer material provides both strength and resistance to chemical attack.

Figure 6:
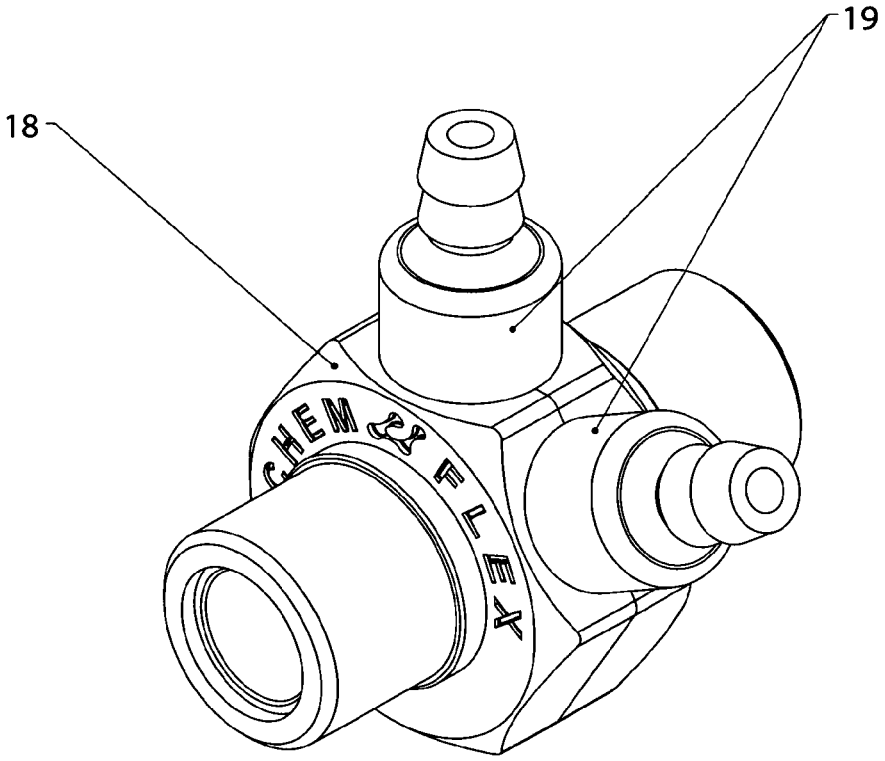
FIG. 6 is a perspective view of a dual eductor leg injector assembly depicting a further embodiment of the present invention.

A dual eductor leg injector assembly 18 is depicted as yet a further embodiment of this invention in FIG. 6. This apparatus is identical to that previously described and referenced from FIG. 4 and FIG. 5 with the exception that this embodiment has two eductor legs 19 in FIG. 6. Where it is desired to mix two concentrated chemicals with a motive stream, typically water, this embodiment may be used. In this embodiment each eductor sub assembly 19 is identical to that described from FIG. 5. A metal insert similar to 1 of FIG. 1 having both a threaded inlet end as in 1*a* of FIG. 1 and a threaded outlet end as in 1*b* of FIG. 1 is over-molded with an inert polymer to produce the geometry shown in FIG. 6. The motive fluid path in this embodiment is identical to that shown in FIG. 5.

It is anticipated there will be applications where connections to an injector assembly may require geometry other than flanged or threaded on either inlet or outlet ends of the eductor bodies described herein. Such alterations can be made without breaching the scope if this invention.

What is claimed is:

1. An eductor assembly comprising:

a single piece metallic insert having a tubular body with a circular cross-section defined between an inlet end and an outlet end, the tubular body including a wall opening defined between the inlet end and the outlet end; and an inert polymer molded over the single piece metallic insert so as to simultaneously define both a motive fluid stream within the metallic insert and an eductor body external to the wall opening, the eductor body having a molded injector inlet formed integrally with and in fluid communication with the motive fluid stream, the motive fluid stream including a motive fluid inlet, a venturi throat, a mixing zone and a mixed fluid outlet, the motive fluid stream shaped to optimize venturi efficiency such that the motive fluid stream has a different internal geometry than the single piece metallic insert, the inert polymer forming a wetted portion of the eductor assembly, wherein a non-wetted portion of the single piece metallic insert is exposed at the inlet end and the outlet end so as to provide the inlet and outlet ends with a metallic connecting surface;

an injector assembly mounted to the eductor body and fluidly connected to the injector inlet; and a spray nozzle positioned within the inlet end.

2. The eductor assembly of claim 1, wherein the injector assembly is permanently mounted within the eductor body.

3. The eductor assembly of claim 1, further comprising a second injector assembly mounted to the eductor body, the eductor body including a second injector inlet fluidly connected to the motive fluid stream.

4. The eductor assembly of claim 1, wherein the non-wetted portion includes a flanged connection at the inlet end and at the outlet end.

5. The eductor assembly of claim 1, wherein the inert polymer defines a molded radiused transition between the venturi throat and the mixed fluid outlet.

6. The eductor assembly of claim 1, wherein the spray nozzle is integrally molded within the inlet end.

* * * * *